US005393437A

United States Patent [19]

Bower

[11] Patent Number: 5,393,437

[45] Date of Patent: Feb. 28, 1995

[54] FIRE EXTINGUISHING MATERIAL

[75] Inventor: Roger K. Bower, Mansfield, Tex.

[73] Assignee: Chemguard, Inc., Mansfield, Tex.

[21] Appl. No.: 250,916

[22] Filed: May 31, 1994

[51] Int. Cl.[6] ..... A62D 1/00

[52] U.S. Cl. ..... 252/7; 252/4; 252/5; 252/604

[58] Field of Search ..... 252/7, 4, 5, 604

[56] References Cited

U.S. PATENT DOCUMENTS

| | | | |
|---|---|---|---|
| 2,901,428 | 8/1959 | Schulenburg | 252/7 |
| 3,017,348 | 1/1962 | Steppe | 252/2 |
| 3,544,459 | 12/1970 | Hirst | 252/5 |
| 3,830,738 | 8/1974 | Cottrell | 252/4 |
| 4,839,065 | 6/1989 | Vandersall | 252/603 |
| 4,983,326 | 1/1991 | Vandersall | 252/603 |
| 5,338,349 | 8/1994 | Farrar | 106/18.12 |

FOREIGN PATENT DOCUMENTS

| | | |
|---|---|---|
| 0212017 | 3/1987 | European Pat. Off. . |
| 824107 | 11/1959 | United Kingdom . |
| 1248054 | 9/1971 | United Kingdom . |
| 1373406 | 2/1988 | U.S.S.R. . |

*Primary Examiner*—Robert L. Stoll
*Assistant Examiner*—Valerie Fee
*Attorney, Agent, or Firm*—Harry C. Post, III

[57] ABSTRACT

A fire extinguishing material that comprises a particulate material to be projected onto a fire having a particle size of no more that 212 microns, a moisture content of no more than 0.50 parts by weight, a hygroscopicity of no more than 3.00 parts by weight, and a bulk density of about 125 milliliters per 100 grams. The particulate material consists essentially of from about 40 to about 80 parts by weight monoammonium phosphate, from about 32 to 0 parts by weight ammonium sulfate, from about 10 to about 18 parts by weight of one or more carbonates selected from the group consisting essentially of magnesium carbonate, potassium carbonate and calcium carbonate, from about 0 to 15 parts by weight of barium sulfate, about 2.0 parts by weight hydrated aluminum-magnesium silicate, about 0.04 parts by weight of diarylide yellow, and about 0.8 parts by weight of methylhydrogen siloxane.

5 Claims, No Drawings

FIRE EXTINGUISHING MATERIAL

TECHNICAL FIELD

This invention relates to a material used to extinguish fires and, more particularly, to a particulate material used to extinguish a class A, B and C fire.

BACKGROUND ART

It is well known that certain particulate materials have been used to extinguish a class A, B and C fire. These materials are generally used in a fire extinguisher that projects the particulate material onto the fire through the use of an inert gas carrier, such as nitrogen. When the material is sufficiently heated by the fire, it reacts to produce a gas component that snuff the flames.

DISCLOSURE OF INVENTION

Accordingly, it is an object of the present invention to provide a fire extinguishing material that will extinguish a class A, B or C fire.

BEST MODE FOR CARRYING OUT THE INVENTION

The fire extinguishing material of this material is a particulate material adapted to be projected onto a fire having a particle size of no more that 212 microns, a moisture content of no more than 0.50 parts by weight, a hygroscopicity of no more than 3.00 parts by weight, and a bulk density of about 125 milliliters per 100 grams. The particulate material consists essentially of from about 82.2 to about 97.2 parts by weight of a mixture consisting essentially of monoammonium phosphate, ammonium sulfate and one or more carbonates selected from the group consisting essentially of magnesium carbonate, potassium carbonate and calcium carbonate: from about 0 to 15 parts by weight of barium sulfate; about 2.0 parts by weight hydrated aluminum-magnesium silicate: about 0.04 parts by weight of diarylide yellow; and about 0.80 parts by weight of methylhydrogen siloxane.

Also, the fire extinguishing material of this invention is a particulate material adapted to be projected onto a fire having a particle size of no more than 212 microns, a moisture content of no more than 0.50 parts by weight, a hygroscopicity of no more than 3.00 parts by weight, and a bulk density of about 125 milliliters per 100 grams. The particulate material consists essentially of from about 40 to about 80 parts by weight of monoammonium phosphate; from about 0 to 32 parts by weight of ammonium sulfate; from about 10 to about 18 parts by weight of one or more carbonates selected from the group consisting essentially of magnesium carbonate, potassium carbonate and calcium carbonate; from about 0 to 15 parts by weight of barium sulfate; about 2.0 parts by weight of hydrated aluminum-magnesium silicate; about 0.04 parts by weight of diarylide yellow; and about 0.8 parts by weight of methylhydrogen siloxane.

The active ingredients in this fire extinguishing materials are selected from a group consisting essentially of monoammonium phosphate, ammonium sulfate and one or more carbonates selected from the group consisting essentially of magnesium carbonate, potassium carbonate and calcium carbonate in an amount of from about 82.2 to about 97.2 parts by weight. The active ingredients consist essentially of from about 40 to about 80 parts by weight of monoammonium phosphate, from about 0 to 32 parts by weight of ammonium sulfate, and from about 10 to about 18 parts by weight of the selected carbonates.

The material has a moisture content of no more than 0.50 parts by weight and a drying agent is added to the material to prevent moisture from adversely effecting the active ingredients. The preferred desiccant is hydrated aluminum-magnesium silicate in the amount of about 2.0 parts by weight.

The material has a bulk density of about 125 milliliters per 100 grams by using barium sulfate as a filler and the amount is preferably from about 0 to 15 parts by weight.

To prevent mixing this fire extinguishing material with adverse chemicals, the material contains sufficient colorant to achieve a yellow color. The colorant is, preferably, a diarylide yellow dye in an amount of about 0.04 parts by weight.

After the moisture in the material is removed, its moisture content is maintained by being coated. The preferred coating material is methylhydrogen siloxane in an amount of about 0.8 parts by weight.

The fire extinguishing material may be provided in a conventional hand held dry chemical fire extinguisher or other conventional system. In such extinguisher or system, an inert gas, such as nitrogen, is used to propel a particulate material onto the fire.

The fire extinguishing materials of this invention comply with a test proposed by Underwriter Laboratories identified as UL 711 as an indication of the materials' ability to extinguish Class A, B and C fires.

The following examples are presented to illustrate the steps to be followed in manufacturing the fire extinguishing material.

EXAMPLE I 4,000 pounds of monoammonium phosphate, 3,216 pounds of ammonium sulfate and 1,000 pounds of a 2:1 ratio of a mixture of magnesium carbonate to calcium carbonate are ground to a powder that is 50% less than 45 microns. This ground material is then loaded into a pre-heated ribbon blender and mixed with particulate matter having a particle size of less than 212 microns, the particulate matter being 1,500 pounds of barium sulfate, 200 pounds of hydrated aluminum-magnesium silicate and four pounds of diarylide yellow dye, for a period of 3 hours at a temperature of 180° F. 80 pounds of methylhydrogen siloxane is added to this heated mixture and mixed for 1 hour at a temperature of 180° F. The mixture is then filtered to eliminate any particles larger than 212 microns. A test of the resultant filtered mixture passes the UL 711 test indicating that it is able to extinguish Class A, B and C fires.

EXAMPLE II 5,000 pounds of monoammonium phosphate, 2,516 pounds of ammonium sulfate and 1,200 pounds of magnesium carbonate are ground to a powder that is 50% less than 45 microns. This ground material is then loaded into a pre-heated ribbon blender and mixed with particulate matter having a particle size of less than 212 microns, the particulate matter being 1,000 pounds of barium sulfate, 200 pounds of hydrated aluminum-magnesium silicate and four pounds of diarylide yellow dye, for a period of 3 hours at a temperature of 180° F. 80 pounds of methylhydrogen siloxane is added to this heated mixture and mixed for 1 hour at a temperature of 180° F. The mixture is then filtered to eliminate any particles larger than 212 microns. A test of the resultant filtered mixture passes the UL 711 test indicating that it is able to extinguish Class A, B and C fires.

EXAMPLE III 6,000 pounds of monoammonium phosphate, 1,216 pounds of ammonium sulfate and 1,500 pounds of a 2:1 ratio of a mixture of magnesium carbonate to potassium carbonate are ground to a powder that is 50% less than 45 microns. This ground material is then loaded into a pre-heated ribbon blender and mixed with particulate matter having a particle size of less than 212 microns, the particulate matter being 1,000 pounds of barium sulfate, 200 pounds of hydrated aluminum-magnesium silicate and four pounds of diarylide yellow dye, for a period of 3 hours at a temperature of 180° F. 80 pounds of methylhydrogen siloxane is added to this heated mixture and mixed for 1 hour at a temperature of 180° F. The mixture is then filtered to eliminate any particles larger than 212 microns. A test of the resultant filtered mixture passes the UL 711 test indicating that it is able to extinguish Class A, B and C fires.

EXAMPLE IV 7,058 pounds of monoammonium phosphate, 0 pounds of ammonium sulfate and 1,658 pounds of a 1:1 ratio of a mixture of magnesium and calcium carbonate are ground to a powder that is 50% less than 45 microns. This ground material is then loaded into a preheated ribbon blender and mixed with particulate matter having a particle size of less than 212 microns, the particulate matter being 1,000 pounds of barium sulfate, 200 pounds of hydrated aluminum-magnesium silicate and four pounds of diarylide yellow dye, for a period of 3 hours at a temperature of 180° F. 80 pounds of methylhydrogen siloxane is added to this heated mixture and mixed for 1 hour at a temperature of 180° F. The mixture is then filtered to eliminate any particles larger than 212 microns. A test of the resultant filtered mixture passes the UL 711 test indicating that it is able to extinguish Class A, B and C fires.

EXAMPLE V 7,873 pounds of monoammonium phosphate, 0 pounds of ammonium sulfate and 1,847 pounds of a 1:1 ratio of a mixture of magnesium and calcium carbonate are ground to a powder that is 50% less than 45 microns. This ground material is then loaded into a preheated ribbon blender and mixed with particulate matter having a particle size of less than 212 microns, the particulate matter being 200 pounds of hydrated aluminum-magnesium silicate and four pounds of diarylide yellow dye, for a period of 3 hours at a temperature of 1800° F. 80 pounds of methylhydrogen siloxane is added to this heated mixture and mixed for 1 hour at a temperature of 180° F. The mixture is then filtered to eliminate any particles larger than 212 microns. A test of the resultant filtered mixture passes the UL 711 test indicating that it is able to extinguish Class A, B and C fires.

The invention having been described, what is claimed is:

1. A fire extinguishing material, comprising: a particulate material to be projected onto a fire having a particle size of no more that 212 microns, a moisture content of no more than 0.50 parts by weight, a hygroscopicity of no more than 3.00 parts by weight, and a bulk density of about 125 milliliters per 100 grams, the particulate material being from about 97.2 to about 82.2 parts by weight of a mixture consisting essentially of monoammonium phosphate, ammonium sulfate and one or more carbonates selected from the group consisting essentially of magnesium carbonate, potassium carbonate and calcium carbonate; from about 0 to 15 parts by weight of barium sulfate; about 2.0 ,parts by weight hydrated aluminum-magnesium silicate; about 0.04 parts by weight of diarylide yellow; and about 0.8 parts by weight of methylhydrogen siloxane.

2. A fire extinguishing material as set forth in claim 1, further comprising: the particulate material further consisting essentially of: the monoammonium phosphate being from about 40 to about 80 parts by weight, the ammonium sulfate being from about 0 to 32 parts by weight and the selected carbonates being from about 10 to about 18 parts by weight.

3. A fire extinguishing material as set forth in claim 2, further comprising: the particulate material further consisting essentially of: the monoammonium phosphate being from about, 40 to about 60 parts by weight, the ammonium sulfate being from about 12 to 25 parts by weight, the selected carbonates being from about 12 to about 15 parts by weight; and the barium sulfate being from about 0 to about 10 parts by weight.

4. A fire extinguishing material, comprising: a particulate material to be projected onto a fire having a particle size of no more that 212 microns; a moisture content of no more than 0.50 parts by weight: a hygroscopicity of no more than 3.00 parts by weight; and a bulk density of about 125 milliliters per 100 grams: the particulate material consisting essentially of from about 40 to about 80 parts by weight of monoammonium phosphate, from about 0 to 32 parts by weight of ammonium sulfate, from about 10 to about 18 parts by weight of one or more carbonates selected from the group consisting essentially of magnesium carbonate, potassium carbonate and calcium carbonate; from about 0 to 15 parts by weight of barium sulfate; about 2.0 parts by weight of hydrated aluminum-magnesium silicate; about 0.04 parts by weight of diarylide yellow; and about 0.8 parts by weight of methylhydrogen siloxane.

5. A fire extinguishing material as set forth in claim 4, further comprising: the particulate material further consisting essentially of: the monoammonium phosphate being from about 50 to about 60 parts by weight, the ammonium sulfate being from about 12 to about 25 parts by weight, the selected carbonates being from about 12 to about 15 parts by weight; and the barium sulfate being from about 0 to about 10 parts by weight.

* * * * *